US010928158B2

(12) United States Patent
Kupa et al.

(10) Patent No.: US 10,928,158 B2
(45) Date of Patent: Feb. 23, 2021

(54) EXPANDABLE TELESCOPIC BATON

(71) Applicants: Vladimir Kupa, Prague (CZ); Bretislav Kostal, Prague (CZ)

(72) Inventors: Vladimir Kupa, Prague (CZ); Bretislav Kostal, Prague (CZ)

( * ) Notice: Subject to any disclaimer, the term of this patent is extended or adjusted under 35 U.S.C. 154(b) by 0 days.

(21) Appl. No.: 16/409,824

(22) Filed: May 12, 2019

(65) Prior Publication Data

US 2020/0158462 A1 May 21, 2020

(30) Foreign Application Priority Data

Nov. 21, 2018 (CZ) ..... CZ2018-640

(51) Int. Cl.
*F41B 15/02* (2006.01)

(52) U.S. Cl.
CPC ..... *F41B 15/027* (2013.01)

(58) Field of Classification Search
CPC ..... H01Q 1/10; F41B 15/027; A45B 19/06; A45B 19/00; F16L 37/086; F16L 37/0915; F16L 37/0887; F16L 37/0925; F16L 37/092; F16L 37/0927; F16L 37/088
USPC ..... 463/47
See application file for complete search history.

(56) References Cited

U.S. PATENT DOCUMENTS 2,069,377 A * 2/1937 Matthiessen, Jr. .. F16L 37/0842 285/277
4,037,839 A * 7/1977 Nelson ..... F41B 15/027 463/47.7
6,231,447 B1 * 5/2001 Pelkey ..... F41B 15/027 403/368
6,238,292 B1 5/2001 Pelkey
2007/0087844 A1 * 4/2007 Labes ..... F41B 15/027 463/47.2
2013/0150167 A1 * 6/2013 Pelkey ..... F41B 15/027 463/47.7
2014/0194212 A1 * 7/2014 Walter ..... F41B 15/022 463/47.7
2014/0256452 A1 * 9/2014 Cheng ..... F41B 15/027 463/47.7
2015/0038239 A1 * 2/2015 Parsons ..... F41B 15/027 463/47.7
2015/0038240 A1 * 2/2015 Parsons ..... F41B 15/027 463/47.7
2016/0169616 A1 * 6/2016 Cheng ..... F41B 15/00 463/47.7
2018/0031018 A1 * 2/2018 Muirhead ..... F16M 11/28
2020/0158462 A1 * 5/2020 Kupa ..... F41B 15/027

* cited by examiner

*Primary Examiner* — William M Pierce
(74) *Attorney, Agent, or Firm* — Mark M. Friedman

(57) ABSTRACT

The expandable telescopic baton (1) consists of the handle (2), the central tube (5) with secondary locking member, of the end tube (6) with terminal locking member, of the button (4) and of the release rod (8). The locking member comprises at least two lever segments of the first order (9, 9'), whose first tilting arms (11) bear the radial projections (10) securing the tubes (5, 6) in the extended position, the second tilting arms (12) extend inside the tubes (5, 6), and the tilting means comprising the tilting edge (15) ensures the tilting of the segments (9, 9') against the inner wall of the tube (5, 6). The release rod (8) passing through the locking tilts over the segments (9, 9'), thus extending radial projections (10) from the internal radial grooves (7, 7').

10 Claims, 7 Drawing Sheets

EXPANDABLE TELESCOPIC BATON

FIELD OF THE INVENTION

The invention relates to an expandable telescopic baton suitable for the defence against attack by an attacker or in police, military and guard practice.

BACKGROUND OF THE INVENTION

Known expandable telescopic batons mostly consist of several main parts. The first part consists of a tubular handle with a terminal and a button. The second part consists of a central tube, telescopically arranged within the tubular handle. The third part consists of an end tube, telescopically arranged within the central tube. The telescopic mounting of the central tube within the handle and the end tube in the central tube is made with an overlap ensuring that the baton does not fall apart when fully extended. Another part consists of grooves and therein fitted locking means, which, when blocked, maintain the first, second and third parts in the extended position of the baton and, when unblocked, allow the telescopic insertion of the first, second and third parts into the folded position of the baton. The last part is the release rod connected to the button, axially running through the first, second and third parts of the baton and controlling the locking means.

The following documents describe typical embodiment of known expandable telescopic batons. In a specific embodiment according to the patent U.S. Pat. No. 6,238,292B1, a tubular central part and a tubular end part have annular grooves, in which the balls of ball bearings fit. These balls fitted in the grooves form locking means holding the baton in the extended position. The baton is folded by means of locking means, which consists of locking members provided with a central bore with a cam surface, and shoulders with two diameters. Larger diameter pushed the balls into the grooves and smaller diameter makes it possible to push out the balls from the grooves, to unblock the locking means and to fold the baton. To control the locking members there is a release rod, running axially through the whole baton, which has a flared end at the end. The flared end has a cam surface engaged with cam surfaces of the locking members. The flared end also has a slot allowing the radial reduction of the flared end so that the release rod subsequently passes through central bores of the locking members. The disadvantage of this solution is that it is very complex in terms of construction and material-intensive, and grooves for the balls must be very deep so the walls of the tubular parts become thin. The walls of the tubular parts also become thin due to screwed connection of the stops of telescopic tubes in the area of locking balls. The disadvantage of this solution is therefore relatively low strength at high weight.

Other constructional solution is described in document US2016/0169616A1. The locking means comprise semi-circular segments, which are separated from each other by springs and their circumferences fit into the grooves. The segments have lugs which overlap each other partially. The release rod has a tip at the end. When the tip of the release rod passes through the lugs of the locking members, the lugs are forced to one axis and the semi-circular segments slip out of the grooves against the pressure of springs. In this solution, there can easily be wear of the thin end of the release rod or lugs of the segments. This solution is very difficult to manufacture, it is necessary to produce complex screwed members and precise threads in tubes, in which the semi-circular segments are mounted. Another disadvantage is the considerable dimensionality of locking mechanisms. Thus, it is not possible to produce a standard light baton with the thinnest tube with a diameter of 11 mm. In this construction, baton tubes must have a larger diameter, which also means quite greater weight of the baton.

The patent EP1583932B1 describes a reverse design, where, on the contrary, the release rod has a conical enlargement at the end. The locking members consist of plastic crowns, which have radially spaced arms with radial projections at the periphery. The release rod is the telescopic rod, comprising two telescopic parts placed in each other and conically terminated. The conical ends expand arms of the plastic crown and push the radial projections at their ends into the grooves, so they lock the baton in the extended position. When folded, the conical ends of the extension parts of the release rod are removed from the crowns, and the arms of the crowns radially spring back only because of the inherent elasticity of springs and the radial projections slip out of the grooves. The disadvantage of this solution consists in that the arms with radial projections are not mechanically controlled for their extension from the grooves and the folding of the baton. In case of damage to the arms or material defect or fatigue, the baton cannot be folded. Another disadvantage consists in the two-piece telescopic design of the release rod. The thin extension part can be easily damaged or bent, which also leads to the impossibility to fold the baton. The locking mechanism in this solution is also large, i.e. baton with thinner tubes cannot be produced. Moreover, the baton tubes are secured against the disintegration only by means of thin steel rings, which is not reliable solution.

The present invention is to provide an expandable telescopic baton, which is easy to manufacture, lightweight, with high strength and reliability in operation, wherein the release rod and the locking members are resistant to shock and ensure reliable extension and folding of the baton, even under severe operating conditions.

SUMMARY OF THE INVENTION

This task has been resolved by the manufacture of the expandable baton according to the disclosed invention. According to the prior art, the expandable telescopic baton consists of a tubular handle provided with a terminal and a button, of a central tube telescopically mounted with an overlap in the handle, and of an end tube telescopically mounted with an overlap in the central tube. The handle and the central tube are provided with internal radial grooves. Further, it consists of a central locking member arranged in the central tube, and of a terminal locking member arranged in the end tube. The locking members are provided with radial projections for fitting in the internal radial grooves in the extended state of the baton. Finally, it consists of a release rod whose one end is connected with a button and the other end fits into the locking members to extend their radial projections from the internal radial grooves when the baton is folded. The summary of the invention rests in the new design of the locking members. The central locking member and/or the terminal locking member comprise at least two lever segments of the first order, arranged in a circle in the tube around its axis. Lever segments of the first order are formed by the first tilting arms and the second tilting arms, wherein ends of the first tilting arms extend from the tube and are provided with radial projections for fitting into the internal radial grooves when locking the baton in the extended state. Second tilting arms are all arranged within the tube. Lever segments of the first order are provided on their outer side, to be understood as the side facing the inside of the tube, in the region between the first tilting arm and the second tilting arm, with tilting means for tilting the segments against the inner wall of the tube, and securing means for fixing the position of the segments in the tube against axial displacement. On the inner side, to be understood as the side closer to the tube axis, the segments are provided with an elastic element separating the ends of the first tilting arms with radial projections. Furthermore, the segments on the inner side are dimensionally adjusted so that in the position of fitting of the radial projections into the internal radial grooves, the smallest internal clear distance $L_2$ between the second tilting arms is smaller than the smallest internal clear distance $L_1$ between the first tilting arms and at the same time smaller than the diameter (d) of the release rod.

The locking member when inserting the central tube into the handle and the end tube into the central tube operates so that the release rod after pressing the button runs into the central locking member between the lever segments of the first order, pushes apart ends of the second tilting arms, when the lever segments of the first order tilt over the tilting means, while the ends of the first tilting arms get closer to the tube axis. This extends the radial projections from the internal radial groove of the handle and the central tube can be inserted into the handle. The same process occurs at the terminal locking member, where the release bar comes after the central tube is inserted into the handle.

In a preferred embodiment, the tilting means for tilting of the segments against the internal wall of the tube is formed so that the outer side of the first tilting arm has the shape of part of the cylindrical surface and the outer side of the second tilting arm has the shape of part of the conical surface, wherein the shape transition between the first tilting arm and the second tilting arm forms the tilting edge in the shape of part of the ring, fitting against the internal wall of the tube. The tilting means can also be created by other methods known to the expert, but the advantage of this embodiment consists in that the locking members can be easily assembled into the tubes and are simple to manufacture.

In another preferred embodiment, the central locking member and/or the terminal locking member comprises two opposite pairs of segments arranged to form a hollow cylindrical body, where the segments are distributed over its circumference at 90°. The locking members would operate even with a smaller number of segments, e.g. two or three, but in this embodiment, the force required to extend the radial projections from the internal radial grooves is ideally distributed.

In another preferred embodiment, the securing means form a spring ring positioned in a recess formed at the periphery of the first tilting arms of the segments and in the inner tube wall. In this embodiment, the advantage consists again in easy manufacture and easy assembly.

In another preferred embodiment, the elastic element has a toroidal shape and is positioned in the grooves on the inner side of the ends of the first tilting arms. The circular shape of the elastic element is ideal for distribution of the pressing force acting on the radial projections and thus to maintain the reliability of the baton in the extended state.

Another preferred embodiment consists in that in the region of overlap, the handle has a conical part and the central tube has a conical part, wherein the said conical parts fit against each other in the extended position of the central tube, and the end of the central tube is aligned with the edge of the internal radial groove in the handle. The conical parts and securing the ends of tubes with radial projections of the segments fitting into the internal radial grooves very significantly enhance the strength of the baton in the extended position in all directions and thereby make it resistant even under adverse conditions.

In a similar preferred embodiment, in the region of overlap, the central tube has a conical part and the end tube has a conical part, wherein the said conical parts fit against each other in the extended position of the end tube, and the end of the end tube is aligned with the edge of the internal radial groove in the central tube.

For easy operation of the locking members, the segments are preferably on the inner side of the second tilting arms provided with release projections with the edge in the shape of part of the ring for fitting against the circumference of the release rod. In this embodiment, the smallest clear distance between the second tilting arms is defined by the edges of the release projections.

In another preferred embodiment, the segments on the inner side in the region between the first tilting arms and the second tilting arms are provided with guide projections with the edge in the shape of part of the ring for fitting against the circumference of the release rod. The release rod first extends between the guide projections and then between the release projections. The guide projections hold the release rod in the tube axis to ensure an even tilting of segments when unlocking the baton and also allow easy and gradual tilting of lever segments of the first order, which are preferably made of metal.

Advantages of the expandable telescopic baton of the invention consist especially in that it is easy to manufacture, light-weight, and in particular it has a high strength and reliability in operation even under severe operating conditions. The release rod is one-piece and robust rod as well as the locking members, and its design allows a reliable mechanical insertion and extension of the radial projections into the internal radial grooves, i.e. a reliable locking of the baton in the extended state, and easy and reliable folding of the baton into the folded state. Another significant advantage is due to small size of the locking mechanism the possibility of producing in this way the baton with the end tube of smaller diameter.

BRIEF DESCRIPTION OF DRAWINGS

The invention will be explained in detail by drawings where the following is illustrated.

EXAMPLES OF THE INVENTION EMBODIMENTS

Figure 1:
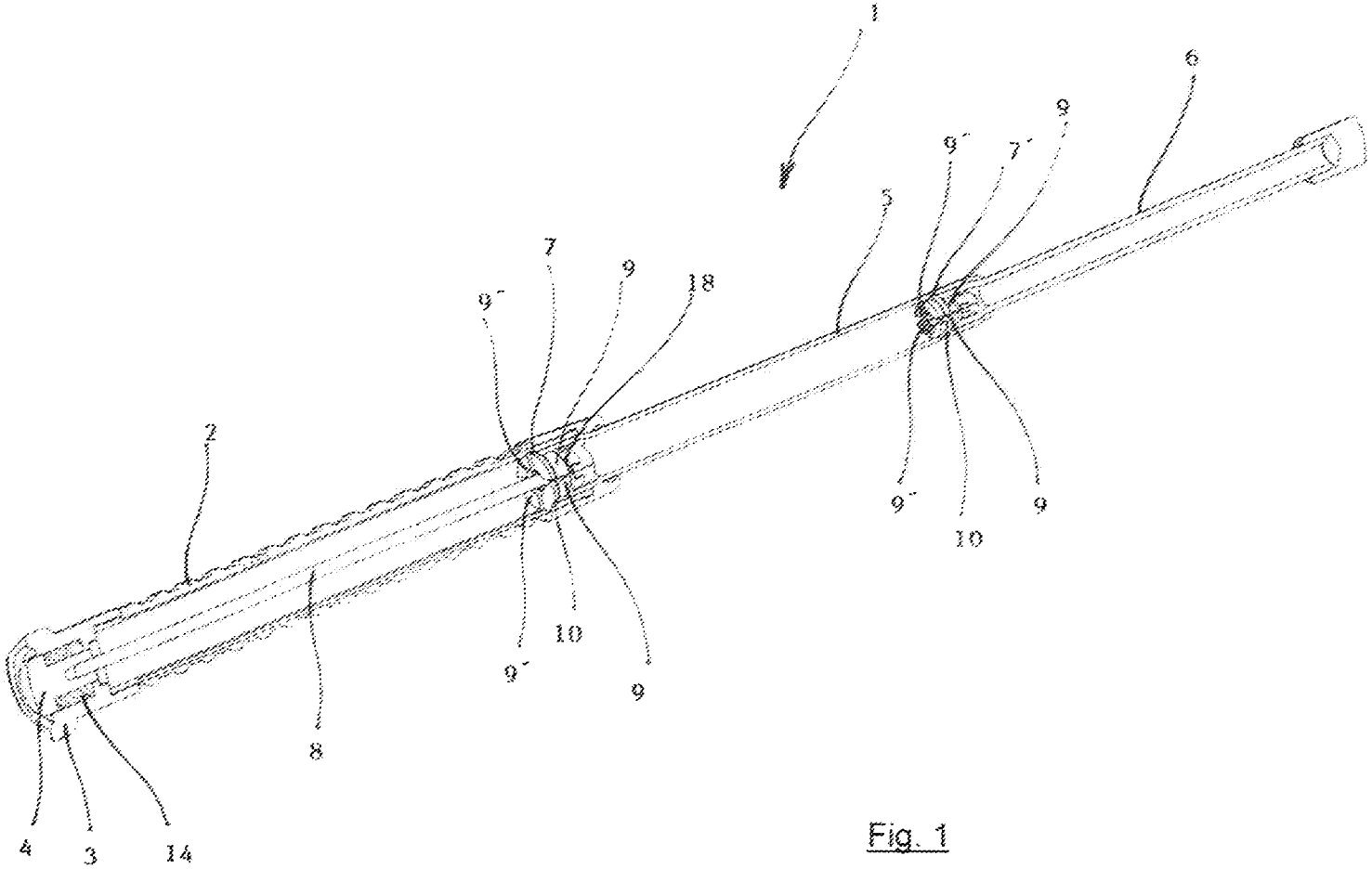
FIG. 1 sectional view of the expandable telescopic baton in the extended state, with a view of the central locking member and a terminal locking member, FIG. 2 sectional view of the expandable telescopic baton as shown in FIG. 1 with partial sectional views of the central locking member and the terminal locking member, FIG. 3 sectional view of the expandable telescopic baton in a partially folded state, with the central tube inserted in the handle and with the end tube extended from the central tube, FIG. 4 sectional view of the expandable telescopic baton in a fully folded state, FIG. 5 sectional view of the terminal locking member in extension of the end tube from the central tube, FIG. 6 sectional view of the terminal locking member in insertion of the end tube into the central tube, FIG. 7 sectional view of the central locking member in extension of the central tube from the handle, in the embodiment with the guide projection.
Figure 2:
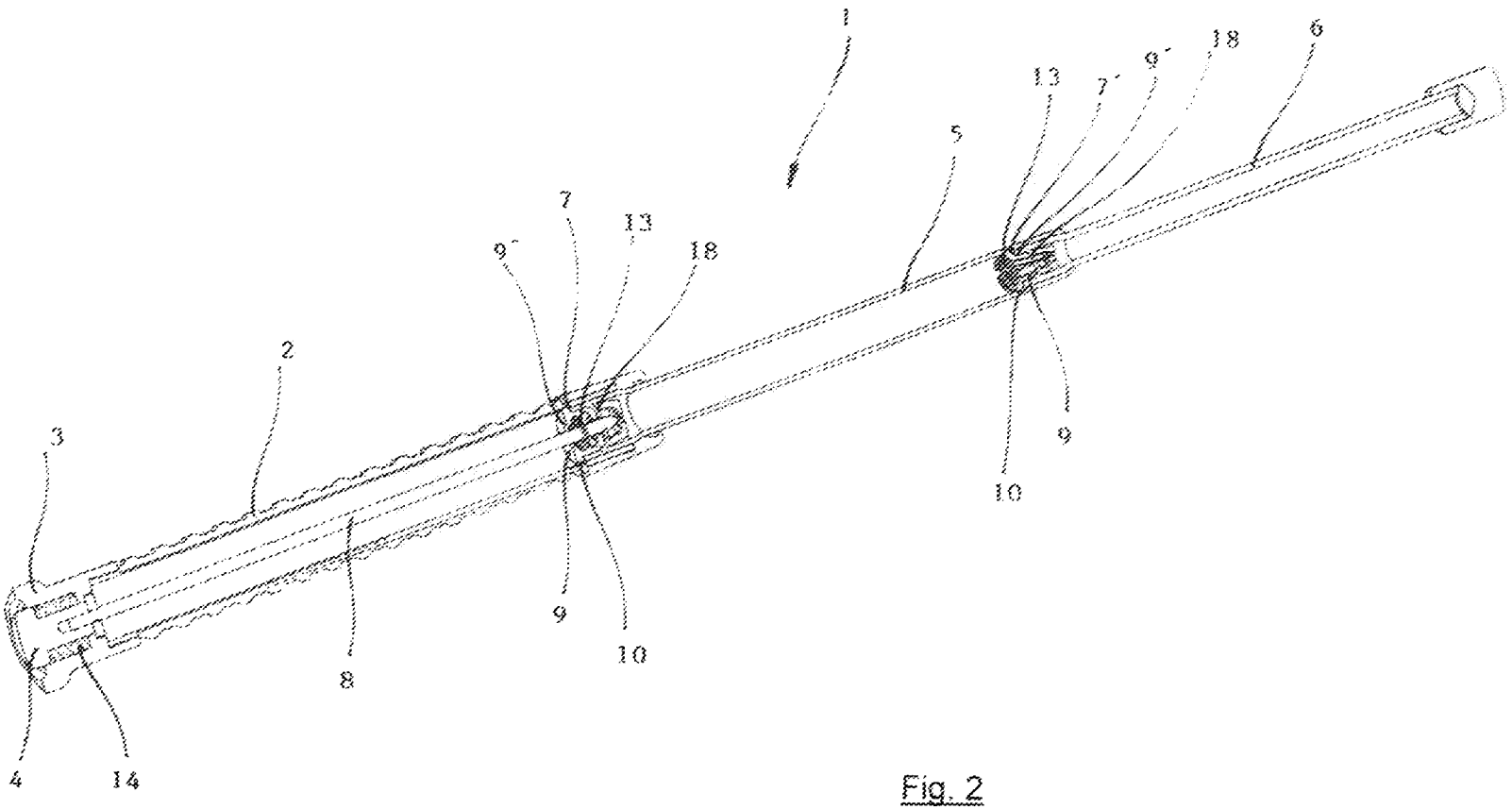
Figure 3:
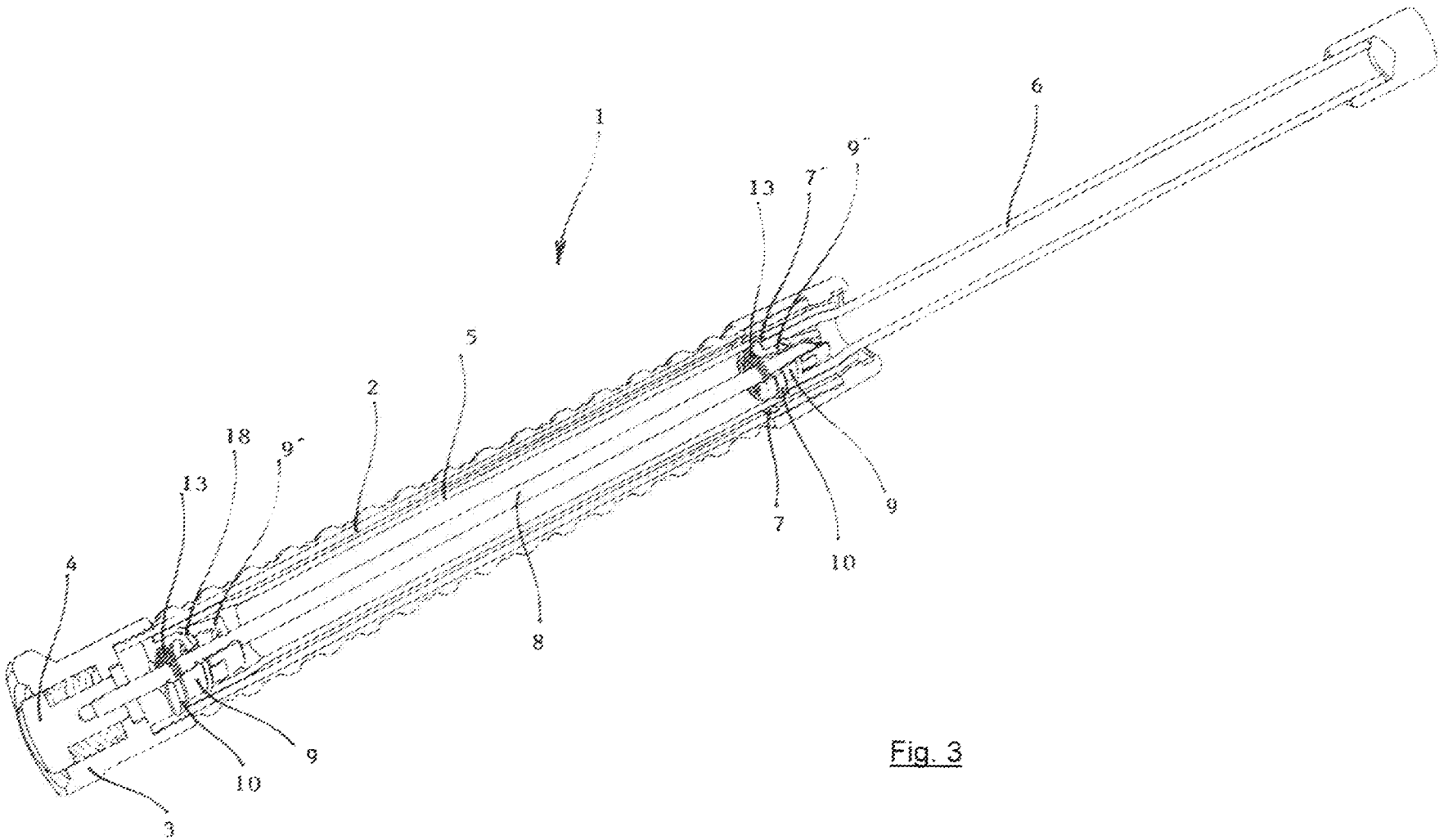
Figure 4:
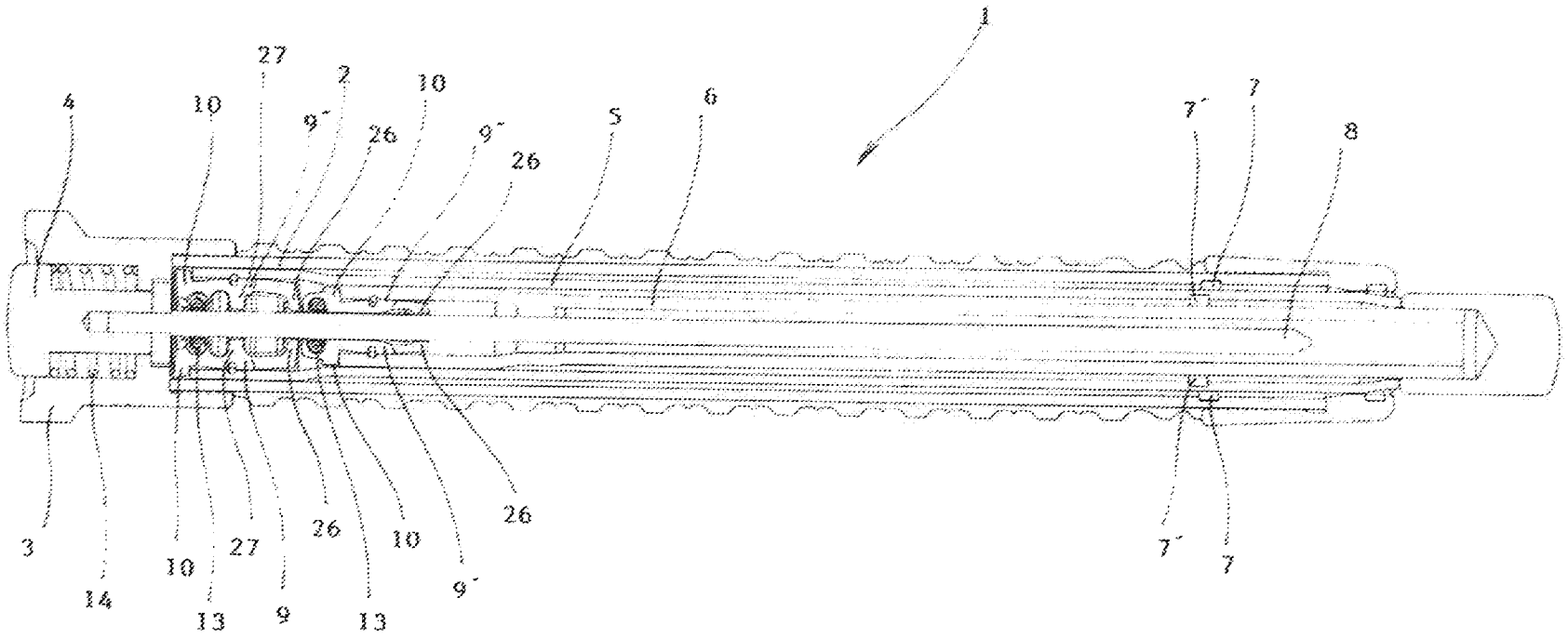

The expandable telescopic baton 1 consists of three cylindrical telescopic parts placed in each other. The tubular handle 2 has the largest diameter, is formed by a metal tube coated with a rubber or plastic coating, and on one side is terminated by terminal 3, in which the button 4 is sliding-mounted on the spring 14. The button 4 fits against the end of the release rod 8, which extends in the axis of the handle 2 to its free end. The central tube 5 is mounted with an overlap, whose outer diameter is smaller than the inner diameter of the handle 2 so that the central tube 5 is sliding-mounted in the handle 2 and can be telescopically inserted and extended, while maintaining the required linear overlap so as not to completely fall out of the handle 2 in full extension. In the central tube 5, the end tube 6 is further mounted, whose outer diameter is smaller than the inner diameter of the central tube 5 so that the end tube 6 is sliding-mounted in the central tube 5 and can be telescopically inserted and extended, while maintaining the required linear overlap so as not to completely fall out of the central tube 5 in full extension. To prevent the central tube 5 from being inserted back into the handle 2 and the end tube 6 from being inserted back into the central tube 5, the handle 2 and the central tube 5 are provided with internal radial grooves 7, 7'. In the extended position of the baton 1, the movable radial projections 10 fit into these internal radial grooves 7, 7', which are part of the central locking member mounted in the central tube 5 and the terminal locking member mounted in the end tube 6. The extended position of the baton 1 is shown in FIG. 1 and FIG. 2. The movement of the radial projections 10 is actuated by the release rod 8, the end of which in the extended state of the baton 1 after pressing the button 4 passes through the central locking member and extends the radial projections 10 from the internal radial groove 7 in the handle 2. The central tube 5 with the central locking member is inserted into the handle 2, wherein the release rod 8 still passes through the central locking member. This partially folded state of the baton 1 is shown in FIG. 3. The end tube 6 in the extended state is displaced along the central tube 5 towards the handle 2 until the end of the release rod 8 passes through the terminal locking member mounted in the end tube 6. In this state, the radial projections 10 extend from the internal radial groove 7' in the central tube 5, and the end tube 6 is inserted into the central tube 5, whereby the baton 1 is in a fully folded state as shown in FIG. 4.

Figure 5:
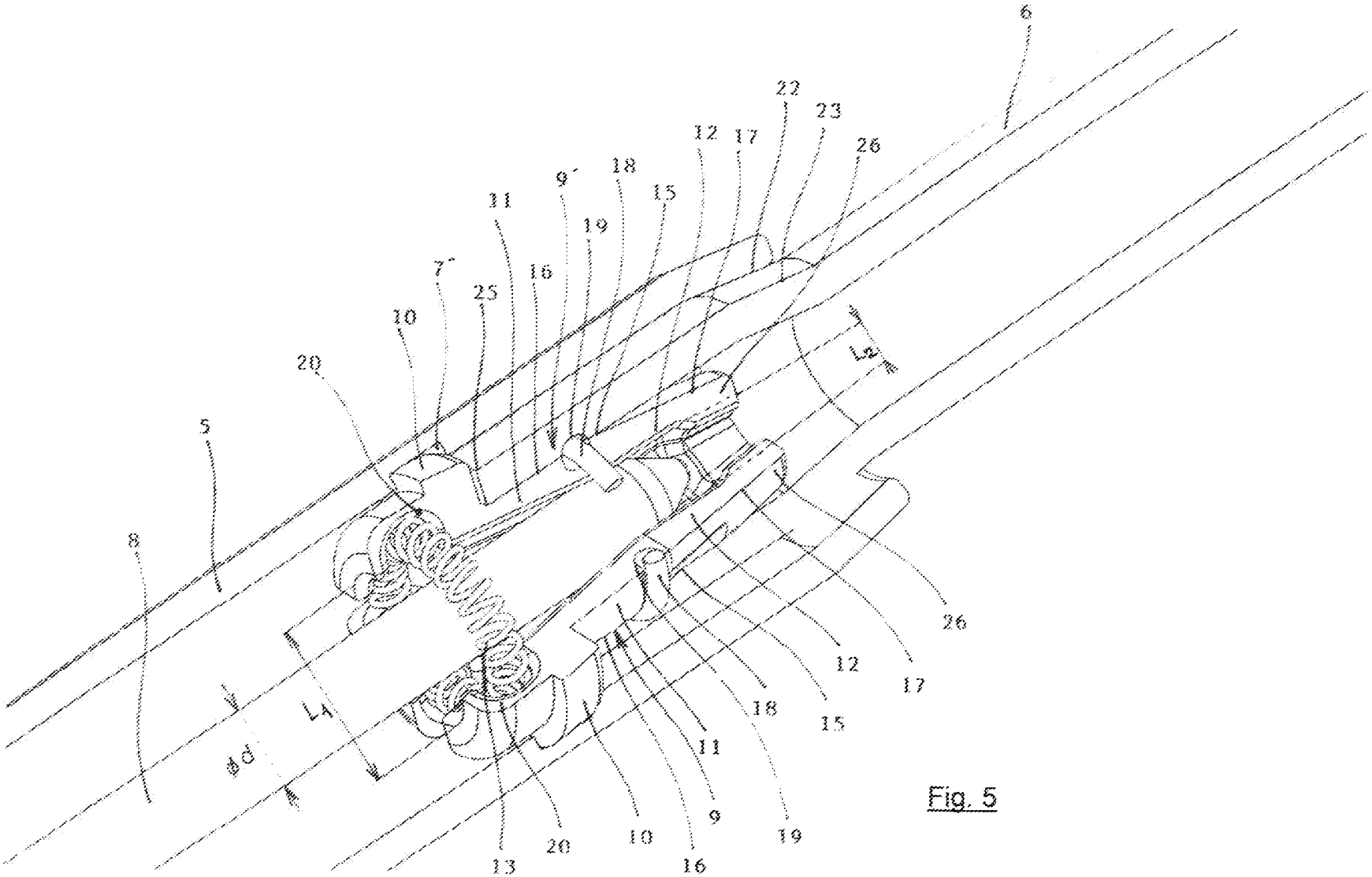
Figure 6:
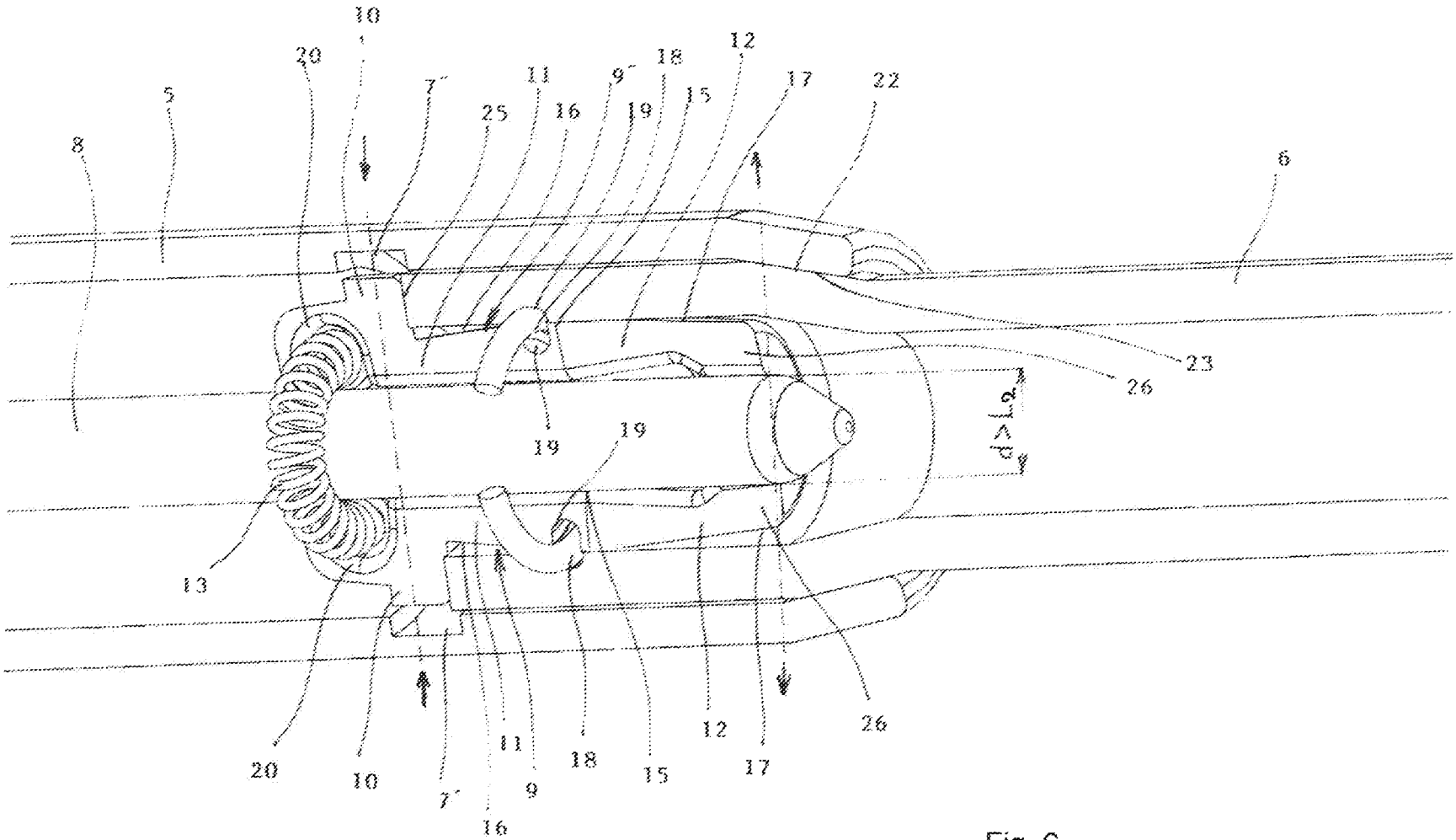

The design of the terminal locking member and the mounting of overlap of the end tube 6 in the central tube 5 is shown in FIG. 5 and FIG. 6. The central tube 5 has the conical part 21, the end tube 6 has the conical part 22. The conical parts 21, 22 fit against each other in the extended position of the end tube 6, thus defining precisely the mutual position of the tubes 5, 6 without clearance. Since the connection of conical parts 21, 22 is not self-locking, the mutual position of the tubes 5, 6 in the extended position is secured by the terminal locking member. Moreover, the conical parts 21, 22 of the tubes 5, 6 are connected again to the cylindrical parts of the tubes, and the end 25 of the cylindrical part of the end tube 6 is aligned with the edge of the internal radial groove 7 in the central tube 5. The radial projection 10 of the terminal locking member is shaped so that when fitted into the internal radial groove 7', its one side fits against the end 25 of the end tube 6. Very rigid and stable connection of the central tube 5 and the end tube 6 in the extended position is thus achieved. FIG. 5 and FIG. 6 also show the detailed construction of the terminal locking member.

The terminal locking member comprises two pairs of lever segments of the first order 9, 9', arranged opposite to each other in the end tube 6 symmetrically to its axis. FIG. 5 shows a partial sectional view, where one segment 9' is removed, FIG. 6 shows an axial sectional view, where one pair of segments 9, 9' is visible. Four segments 9, 9' are arranged to form a hollow cylindrical body, where the segments 9, 9' are distributed over its circumference at 90°. In another embodiment, the terminal locking member could also work with three or two segments 9, 9'.

The lever segments of the first order 9, 9' are made of metal, but may also be made of durable plastic or composite. Each segment 9, 9' is formed as a two-armed lever and comprises the first tilting arm 11 and the second tilting arm 12. The first tilting arm 11 extends from the end tube 6 and bears the radial projection 10. This means that the terminal locking member has four radial projections 10 fitting into the internal radial groove 7' in the central tube 5, each segment 9, 9' has one quadrant radial projection 10.

The elongated parts of the first tilting arms 11 after the radial projections 10 also extend to the central tube 5 and are provided on their inner side with grooves 20, in which the elastic element 13 is mounted, comprised of the metal coil in a toroidal shape. This elastic element 13 permanently separates the ends of the first tilting arms 11 and pushes the radial projections 10 into the internal radial groove 7'. The end of the release rod 8 can pass through the centre of the elastic element 13 into the terminal locking member. However, the elastic member 13 may be of design known to the expert.

Part of the first tilting arms 11, mounted in the end tube 6, has the outer surface made in the shape of part of the cylindrical surface. The outer surface means surface closer to the inner wall of the end tube 6. The second tilting arms 12, connected in the end tube 6 to the first tilting arms 11, have the outer surface in the shape of part of the conical surface. The transition between the first tilting arm 11 and the second tilting arm 12 forms the tilting edge 15 fitting against the inner wall of the end tube 6. The lever segment of the first order 9, 9' may tilt over the tilting edge 15 to one or another side. The tilting means may be designed in another way than the tilting edge 15, e.g. a projection in the groove, pin, etc., but the tilting edge 15 has the advantage that it is the most simple and economic way to manufacture, fits against the inner wall of the end tube 6 completely free of clearance and achieves precise positioning.

On the first tilting arms 11 and in the inner wall of the end tube 6, there are recesses 19, in which the securing means 18 formed of a spring ring is mounted. The securing means 18 fixes axially the position of the lever segments of the first order 9, 9' in the end tube 6.

On the inner side, to be understood as the side closer to the axis of the tube 6, the lever segments of the first order 9, 9' are dimensionally adjusted so that in the position of fitting of the radial projections 10 into the internal radial groove 7', the smallest internal clear distance $L_2$ between the second tilting arms 12 is smaller than the smallest internal clear distance $L_1$ between the first tilting arms 11 and at the same time smaller than the diameter d of the release rod 8. This is achieved so that at the end of the second tilting arms 12 on their inner side there are the release projections 26 with the edge in the shape of part of the ring for fitting against the circumference of the release rod 8. When the release rod 8 extends inside the terminal locking member, it fits against the release projections 26, thus separating the ends of the second tilting arms 12. The lever segments of the first order 9, 9' are tilted over so that the first tilting arm 11 tilts through the resistance of the elastic element 13 and over the tilting edge 15 towards the axis of the end tube 6, so that the radial projections 10 extend from the internal radial groove 7' and the end tube 6 can be inserted into the central tube 5, e.g. by hand pressure.

Figure 7:
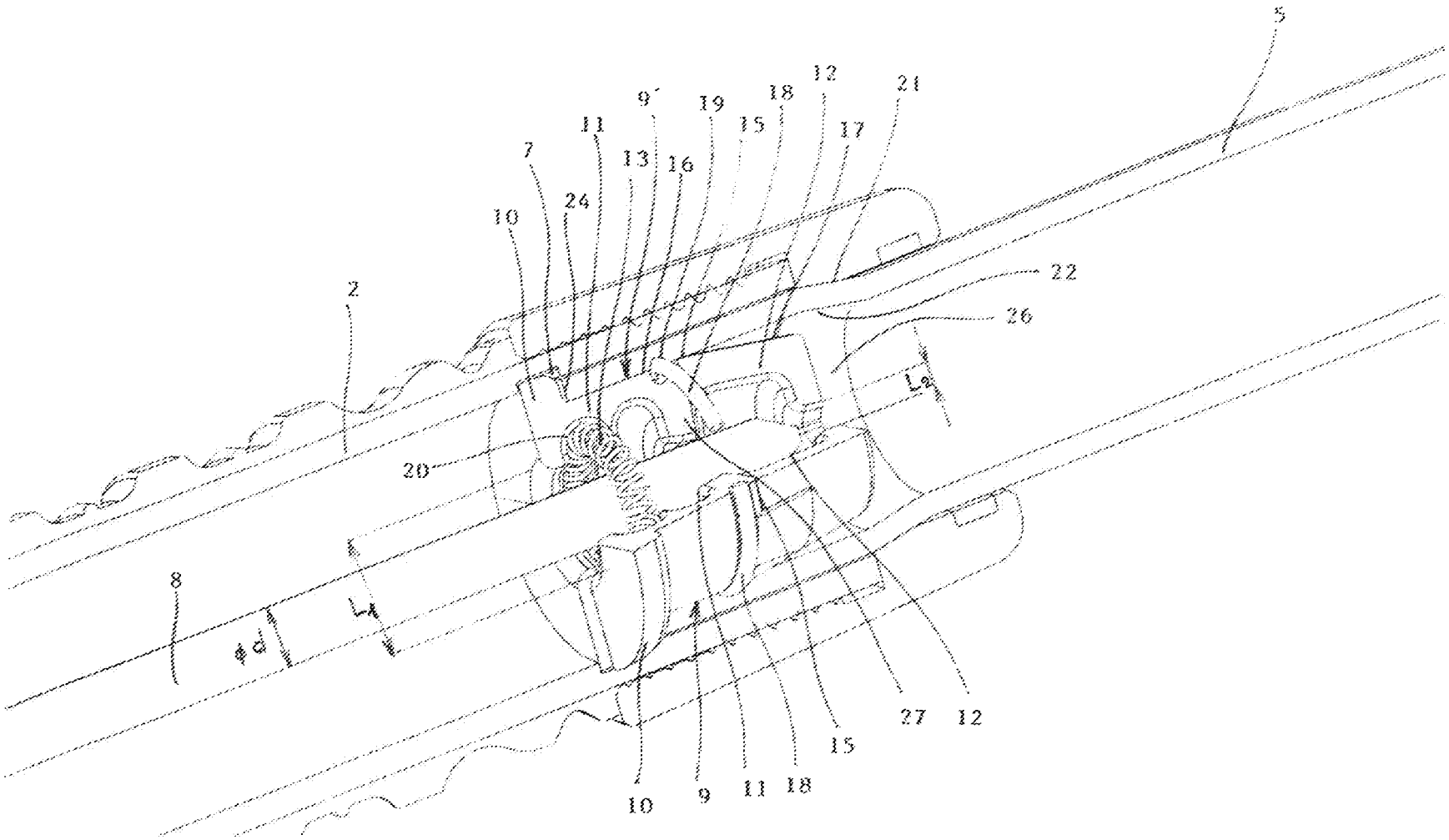

The central locking member, shown in FIG. 7 and FIG. 8, operates as the terminal locking member, with the difference that it is positioned in the central tube 5, which has the conical part 22 fitting into the conical part 21 of the handle 2, and the radial projections 10 fit into the internal radial groove 7 in the handle 2. FIG. 4 and FIG. 7 also show an alternative embodiment of lever segments of the first order 9, 9', where the elastic element 13 is positioned in the grooves 20 substantially opposite to the radial projections 10 and the segments 9, 9' are in the region between the first tilting arms 11 and the second tilting arms 12 on the inner side provided with guide projections 27 in the shape of part of the ring for fitting against the circumference of the release rod 8. This embodiment provides guiding of the release rod 8 in the axis of the tube 5, while allowing easier and gradual tilting of the segments 9, 9'.

LIST OF REFERENCE NUMERALS

1 expandable telescopic baton
2 tubular handle
3 terminal
4 button
5 central tube
6 end tube
7 internal radial groove in the handle
7' internal radial groove in the central tube
8 release rod
9, 9' lever segment of the first order of the locking member
10 radial projection
11 first tilting arm
12 second tilting arm
13 elastic element
14 button spring
15 tilting edge
16 cylindrical surface
17 conical surface
18 securing means
19 recess
20 groove on the inner side of the first tilting arm
21 conical part of the handle
22 conical part of the central tube
23 conical part of the end tube
24 end of the central tube
25 end of the end tube
26 release projection
27 guide projection
$L_1$ smallest internal clear distance of the first tilting arms of the segments of central and terminal locking members
$L_2$ smallest internal clear distance of the second tilting arms of the segments of central and terminal locking members
d diameter of the release rod

The invention claimed is:

1. An expandable telescopic baton (1) comprising:

a tubular handle (2) having a terminal portion (3) with a button (4) and a release rod (8) located within said tubular handle in communication with said button;

a central tube (5) contained within said tubular handle such that it covers said release rod, said central tube configured to move between a first position in which it is fully contained within said tubular handle and a second position in which only a portion of said central tube is being held within said tubular handle; and, an end tube (6) contained within said central tube, said end tube configured to move between a first position in which it is fully contained within said central tube and a second position in which only a portion of said end tube is being held within said central tube;

wherein each of said tubular handle (2) and said central tube (5) includes an internal radial groove (7, 7') configured to fit to a corresponding radial projection that is part of a central locking member and a terminal locking member positioned in said central tube and said end tube (6) respectively;

wherein said release rod (8) whose one end is connected with the button (4) and the other end fits into the locking members so as to retract their radial projections (10) from the grooves (7, 7') when the baton (1) is folded;

wherein the central locking member and/or the terminal locking member comprise at least two double reversing lever segments (9, 9') arranged opposite to each other in the tube (5, 6) around its axis, formed by first tilting arms (11) and second tilting arms (12), where the first tilting arms (11) extend from the central and end tubes (5, 6) and are provided with said radial projections (10) for fitting into the grooves (7, 7'), and second tilting arms (12) extend inside the central and end tubes;

wherein on an outer side the segments (9, 9') in a region between the first tilting arms (11) and the second tilting arms (12) are provided with tilting means for tilting the segments (9, 9') against an inner wall of the central and end tubes, and with securing means (18) for fixing the position of the segments (9, 9') in the central and end tubes against displacement;

wherein on an inner side the segments (9, 9') are provided with an elastic element (13) separating ends of the first tilting arms (11) with said radial projections (10); and, wherein the segments (9, 9') on an inner side are dimensionally adjusted so that in the position of fitting of the radial projections (10) into the grooves (7, 7'), the smallest internal clear distance (L2) between the second tilting arms (12) is smaller than the smallest internal clear distance (L1) between the first tilting arms (11) and at the same time smaller than the diameter (d) of the release rod (8).

2. The expandable telescopic baton according to claim 1, wherein the tilting means for tilting of the segments (9, 9') against the internal wall of the central and end tubes are formed so that the outer side of the first tilting arm (11) has a shape of part of a cylindrical surface and the outer side of the second tilting arm (12) has a shape of part of a conical surface, wherein a shape transition between the first tilting arm (11) and the second tilting arm (12) forms a tilting edge (15) in a shape of part of the ring, fitting against the internal wall of the tube (5, 6).

3. The expandable telescopic baton according to claim 1, wherein the central locking member and/or the terminal locking member comprises two opposite pairs of segments (9, 9') arranged to form a hollow cylindrical body, where the segments (9, 9') are distributed over its circumference at 90°.

4. The expandable telescopic baton according to claim 1, wherein the securing means (18) form the spring ring positioned in the recess (19) formed at the periphery of the first tilting arms (11) of the segments (9, 9') and in the inner wall of the central and end tubes.

5. The expandable telescopic baton according to claim 1, wherein the elastic element (13) has a toroidal shape and is positioned in the grooves (20) on the inner side of the ends of the first tilting arms (11).

6. The expandable telescopic baton according to claim 1, wherein the handle (2) has a conical part (21) and the central tube (5) has a conical part (22), where the said conical parts (21, 22) fit against each other in the extended position of the central tube (5), and an end (24) of the central tube (5) is aligned with the edge of the internal radial groove (7) in the handle (2) so that in the extended position of the central tube (5), the radial projection (10) fits against the end (24) of the central tube (5).

7. The expandable telescopic baton according to claim 1, wherein the central tube (5) has a conical part (21) and the end tube (6) has a conical part (22), where the said conical parts (22, 23) fit against each other in the extended position of the end tube (6), and an end (25) of the end tube (6) is aligned with the edge of the internal radial groove (7) in the central tube (5) so that in the extended position of the end tube (6), the radial projection (10) fits against the end (25) of the end tube (6).

8. The expandable telescopic baton according to claim 1, wherein the segments (9, 9') on the inner side of the second tilting arms (12) are provided with release projections (26) with an edge in the shape of part of the ring for fitting against the circumference of the release rod (8).

9. The expandable telescopic baton according to claim 1, wherein the segments (9, 9') on the inner side in the region between the first tilting arms (11) and the second tilting arms (12) are provided with guide projections (27) with an edge in the shape of part of the ring for fitting against the circumference of the release rod (8).

10. The expandable telescopic baton according to claim 1, wherein the segments (9, 9') are made of metal.

* * * * *